US006293784B1

(12) United States Patent
Griffioen

(10) Patent No.: US 6,293,784 B1
(45) Date of Patent: Sep. 25, 2001

(54) PILOT ASSEMBLY

(76) Inventor: Robert Howard Griffioen, 66651 N. Centreville Rd., Sturgis, MI (US) 49091

( * ) Notice: Subject to any disclaimer, the term of this patent is extended or adjusted under 35 U.S.C. 154(b) by 0 days.

(21) Appl. No.: 09/507,762

(22) Filed: Feb. 18, 2000

Related U.S. Application Data

(63) Continuation of application No. 09/244,301, filed on Feb. 3, 1999, now Pat. No. 6,027,335.

(51) Int. Cl.[7] ..... F23D 11/36

(52) U.S. Cl. ..... 431/343; 431/355; 431/278; 431/266; 431/154

(58) Field of Search ..... 431/343, 266, 431/264, 278, 354, 355, 259, 263, 42, 43, 154, 155, 189

(56) References Cited

U.S. PATENT DOCUMENTS

| | | | | |
|---|---|---|---|---|
| 562,410 | | 6/1896 | Moon . | |
| 788,382 | | 4/1905 | Taylor | 431/355 |
| 832,159 | * | 10/1906 | Pratt | 431/355 |
| 1,387,565 | | 8/1921 | Thorp et al. | 431/355 |
| 2,355,216 | | 8/1944 | Guelson | 431/343 |
| 2,780,232 | | 2/1957 | Ney . | |
| 3,747,586 | | 7/1973 | Weiss . | |
| 3,913,846 | * | 10/1975 | Morris | 431/354 |
| 4,678,428 | * | 7/1987 | Tanaka et al. | 431/355 |
| 5,601,789 | | 2/1997 | Ruehl . | |
| 5,902,101 | * | 5/1999 | Palmer et al. | 431/343 |
| 6,095,797 | * | 8/2000 | Haddad et al. | 431/154 |

* cited by examiner

*Primary Examiner*—Ira S. Lazarus
*Assistant Examiner*—Josiah C. Cocks
(74) *Attorney, Agent, or Firm*—Flynn, Thiel, Boutell & Tanis, P.C.

(57) ABSTRACT

A pilot assembly includes a two part pilot housing and an orifice member mounted between the two housing parts. One housing part is fixable to a mount in a gas burning device and has a through passage. The orifice member is received in the passage. At least a portion of the other housing part is received in the passage to fix the orifice member in the passage.

26 Claims, 9 Drawing Sheets

31A
50
107
113
106
66
105
64
115
117
36A
33A
17A
111
79
124
34A
73
97
76
73
77
94
35A
116
98
108
72
80
101
108
40A
96
51A
68
71
83
72
84
78
37A
74
92
82
81
52A
41A
28A

PILOT ASSEMBLY

This application is a Continuation of Ser. No. 09/244,301 filed Feb. 3, 1999, now U.S. Pat. No. 6,027,335.

FIELD OF THE INVENTION

The present invention relates to pilot assemblies, and, more particularly to pilot assemblies of the type having a changeable pilot orifice member.

BACKGROUND OF THE INVENTION

Gaseous fuel (hereafter for simplicity, gas) burning devices, such as conventional hot water heaters and gas fireplaces, typically burn natural gas or propane. Pilot assemblies are conventionally mounted in, and used to light, such gas burning devices. A conventional pilot assembly includes a pilot which continuously burns gas at a low rate to provide a pilot flame. The pilot flame in turn lights an adjacent main burner when gas is supplied to the main burner.

As a convenient example of a conventional environment for such a pilot assembly, a conventional gas fireplace GF (FIG. 7) includes a floor 8, a fireplace box 9 extending upwardly from the floor 8, and conventional fireplace hardware 10 mounted in the fireplace box 9. The box 9 encloses sufficient volume for the fireplace hardware 10 and fireplace flames. The fireplace hardware 10 includes a grate 11 (in broken lines) standing on the floor 8, imitation noncombustible logs 12 (in broken lines) resting on the grate 11, a main burner 13 mounted to the floor 8 in substantially hidden relation behind the grate 11 and logs 12, and a pilot assembly 15. The main burner has plural gas flame producing nozzles 14, some adjacent the pilot assembly 15.

A typical conventional pilot assembly 15 (FIG. 8) includes a horizontal mounting bracket 17 fixed by any conventional means, not shown, with respect to the main burner 13. The pilot assembly 15 is substantially hidden behind the main burner 13. The assembly 15 includes a pilot 19, an ignitor 21, a thermocouple 22, and a thermopile generator 23, which are fixed on, and extend vertically through, the mounting bracket 17 in side-by-side relation.

The pilot 19 (FIG. 8) includes a one piece housing 27 extending vertically through and fixed to the central portion of the bracket 17. A semirigid, metal, gas supply tube 28 connects the bottom of the pilot housing 27 through a conventional pilot valve V to a conventional gas source GS. A typical pilot valve V is spring biased closed (to block gas flow to the pilot 19), but can be opened manually and can be held open electrically (to allow gas flow to the pilot). FIG. 8 schematically shows a suitable conventional pilot valve V comprising a spring biased closed valve core C1 interposed between the gas source GS and pilot supply tube 28, and a manual opener (e.g. push button) B1 and electromagnetic hold-open (e.g. solenoid) E1 actuable to respectively open and hold-open the valve core C1 against its spring S1.

The upper end of the pilot housing 27 normally emits a pilot flame (not shown) fueled by gas supplied through the open valve V and tube 28. A pilot flame target 31 is fixed atop the housing 27 to direct the pilot flame laterally (to the right and left and forward out to the page in FIG. 8) along paths from the target 31. The top of the ignitor 21 (FIG. 8) is adjacent one side (the left side in FIG. 8) of the target 31, for igniting gas flow therefrom to establish the pilot flame of pilot 19. The tops of the thermocouple 22 and thermopile generator 23 closely flank the target 31 (FIG. 8), so as to be in the pilot flame path from opposite sides of the target 31 and with the ignitor 21 snugly spaced between the thermocouple 22 and target 31. The front of the flame target 31 is adjacent ones of the gas outlet nozzles of the main burner 13, such that the forward directed flame pilot flame component ignites the main burner 13.

An electrically insulated wire 24 (FIG. 8) electrically couples the bottom of the ignitor 21 to the output of a conventional ignitor voltage source, here for example a conventional, manually actuable, push button, piezo-electric voltage source PZ, grounded to the bracket 17. Given a supply of gas through the pilot valve V to the pilot 19, manual actuation of the piezo voltage source discharges an electrical spark between the tops of the ignitor 21 and pilot 19, thereby igniting the pilot gas flow and starting the pilot flame.

A relatively stiff wire 25 extends from the bottom of the thermocouple 22 to the control input of the electromagnetic hold-open E1 of pilot valve V. The thermocouple 22, when heated by the pilot flame from pilot 19, supplies a voltage (typically in the range of millivolts) to the solenoid E1 to maintain the valve V open and so maintain gas flow to the pilot and keep the pilot flame on. If the pilot flame becomes extinguished, the thermocouple 22 cools, its voltage output drops, and the solenoid E1 relaxes and the spring S1 closes the valve V and shuts off gas flow to the pilot 19.

The bottom of thermopile generator 23 (FIG. 8) connects through a heat shielded, relatively stiff, electrically insulated wire pair 26 to a main gas safety valve MV interposed between the conventional gas source GS and the main burner 13. The thermopile generator 23 responds to pilot flame heat to electrically open the main valve MV to supply gas from the gas source GS to the main burner 13 and responds to lack of pilot flame heat to close the valve Mv and thus shut off gas flow to the main burner 13. The main safety valve MV may be a conventional solenoid valve (like pilot V but without the manual opener B1) comprising a valve core C2 spring biased closed by a spring S2 and openable by a solenoid E2.

Typically, a manual control MC, in the form of a manually adjustable valve, is in series with the main safety valve MV, between the gas source GS and main burner MB, to allow the human operator of the fireplace GF to turn on and off, and vary the flame height of, the main burner MB.

The top and bottom ends of the one-piece pilot housing 27 (FIG. 9) are spaced above and below the bracket 17. The housing 27 has a radially inwardly stepped, upper housing portion 45. The housing 27 also has a stepped axial through passage 29. The passage 29 has a substantially cylindrical top portion 42, an enlarged-diameter midportion 43 and a further enlarged-diameter, bottom opening, internally threaded recess 44. The portions 42 and 43 are separated by a tapered annular step 46. The midportion 43 and recess 44 are separated by an annular step 47, the upper portion of which is tapered upward and inward. The open top 48 of the passage 29 acts as the ignited gas/air mixture (flame) outlet nozzle of the pilot 19.

The pilot flame target 31 comprises a semi-circular base 38 which is fixed, by any convenient means, such as welding, to the upper housing portion 45. The target 31 has an inverted trough-like, pilot flame deflector 39 fixedly upstanding from the base 38 and spaced above the pilot flame nozzle 48 for deflecting the pilot flame laterally (to the left and right in FIG. 9) toward the ignitor 21, thermocouple 22 and thermopile generator 23 and forwardly (out of the page in FIG. 9) toward the main burner 13.

At least one air supply aperture 32 opens radially through the peripheral wall of the housing 27 and into the midportion 43 of the passage 29. The aperture 32 may be above the bracket 17 as here shown, or below it.

An inverted cup-shaped, pilot orifice-containing member 33 includes a substantially cylindrical peripheral wall 35, a horizontal top end wall 36, a central orifice 34 preferably centered in the end wall 36, and a radially outwardly and downwardly flared bottom flange 40. The orifice member 33 is assembled in the pilot housing 27 by upward insertion through the threaded bottom recess 44. When so installed, as seen in FIG. 9, the top end wall 36, with its orifice 34, is located closely below the air aperture 32, the peripheral wall 35 is in snug sliding engagement with the lower portion of the passage midportion 43, and the bottom flange 40 snugly abuts the tapered step 47.

The pilot gas supply tube 28 has an upper end fixedly tipped by a ferrule 37 (FIG. 9) that is tapered at its upper and lower ends 51 and 52.

A spool-like, annular fitting 41 (FIG. 9) is snugly but axially and rotatably slidably sleeved on the gas supply conduit 28 below the ferrule 37. The fitting 41 adjacent its lower end has a wrench-engageable (here hexagonal) rim 53. The fitting 41 is externally threaded at 54 adjacent its upper end and has a central throughbore 55. The upper end of the fitting throughbore 55 is tapered at 56. The gas supply tube 28 is fixed to the bottom of the housing 27 by inserting the ferrule 37 into the housing bottom recess 44 until it rests against the tapered bottom flange 40 of the orifice member 33. The fitting 41 is then threaded into the threaded bottom recess 44 of the housing 27. Threadedly tightening the fitting 41 axially presses it, fitting taper 56 to ferrule taper 52, against the bottom of the ferrule 37 and in turn presses the ferrule 37 axially upward so that its upper taper 51 forcibly presses the bottom flange 40 against the tapered step 47 of the housing 27. This locks in place the orifice member 33 in the housing 27 and prevents leakage of gas, such that all gas from the gas supply tube 28 must pass up through the orifice 34 and mix with air from the aperture 32, and such that the resultant gas/air mixture must pass upwardly through the passage top portion 42 and out the nozzle 48 for ignition and production of the pilot flame.

However, different fuel gases differ in energy content and so require different sized orifices 34 to supply gas at different flow rates for maintaining the desired size pilot flame. Manufacturers, retailers, and repair persons must thus inventory different pilot assemblies 15 (FIG. 8) for different gaseous fuels, or must change the orifice member 33 (FIG. 9) in a given assembly if a different fuel gas than originally contemplated is to be used. Unfortunately, inventorying different pilot assemblies 15, and more importantly appliances incorporating them, is space consuming and expensive.

Also, unfortunately, in such prior pilot assemblies 15 (FIG. 8), changing the orifice member 33 (FIG. 9) is difficult and time consuming because access to the orifice member 33 is difficult before, and particularly after, prior pilot assembly 15 is installed in a gas burning device, for example a fireplace or water heater. More particularly, to remove the existing pilot orifice member 33, the fitting 41 and gas supply tube 28 must be removed from the bottom of the pilot 19. However, access to the fitting 41 is usually, at least partially, blocked, e.g. by the bracket 17 and main burner 13, if not additionally by user device structure, such as the nonflammable logs 12, grate 11 or a fireplace box 9 (FIG. 7). Further, the stiffness of the gas supply tube 28 requires either that it be bent (thus risking kinking and disabling) away from the pilot 19, or that the bracket 17 be disconnected from supporting structure of a user device and that the relatively stiff electrical conductor members 25, 26 also be disconnected to enable access to the bottom of the pilot 19.

Accordingly, objects of the present invention include providing a pilot assembly having more efficient access to the pilot orifice member, and easing converting the pilot from one gaseous fuel to another.

SUMMARY OF THE INVENTION

The objects and purposes of the present invention, including those set forth above, are met, according to one form of the present invention, by providing a pilot assembly which includes two pilot housing parts, and a pilot orifice member mounted between the two pilot housing parts. One pilot housing part is fixed to a gas supply. The second pilot housing part is removably fixed to the one pilot housing part. In another embodiment of the present invention, the pilot orifice member is accessible from above a bracket by removing an upper housing part upwardly from a cover housing part.

Figure 1:
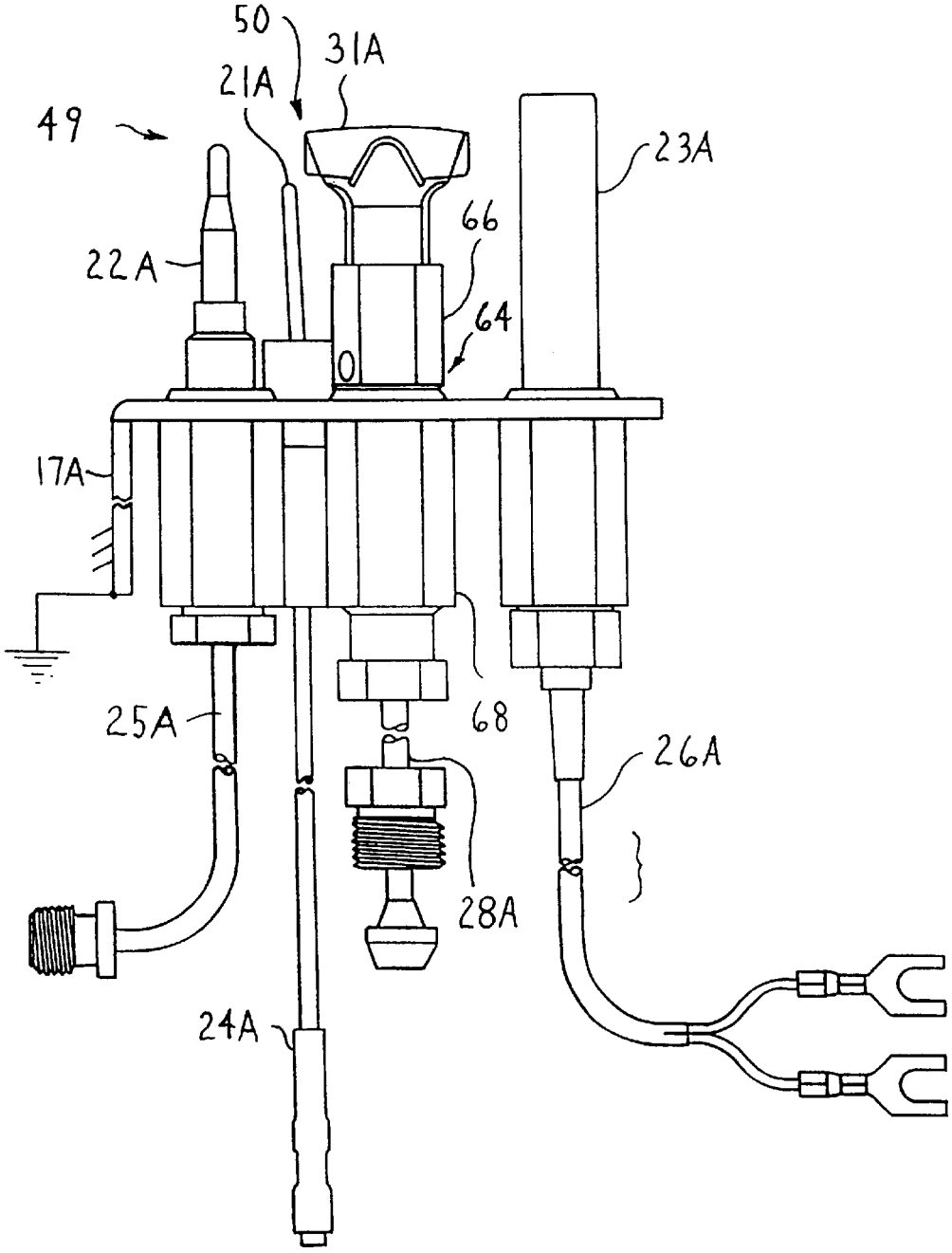
FIG. 1 is an elevational view of a pilot assembly embodying the invention.
Figure 2:
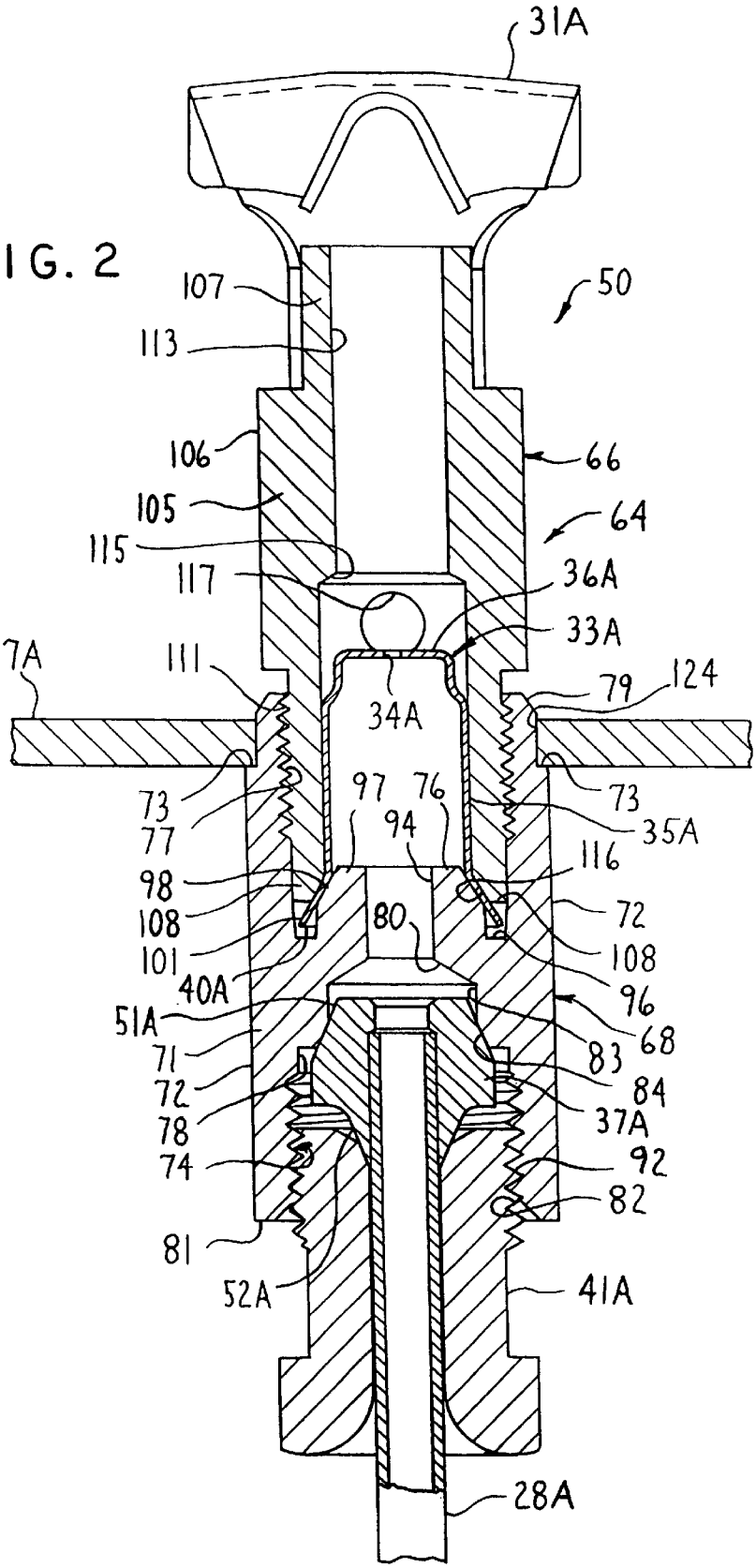
FIG. 2 is a cross sectional view of the pilot of FIG. 1.
Figure 3:
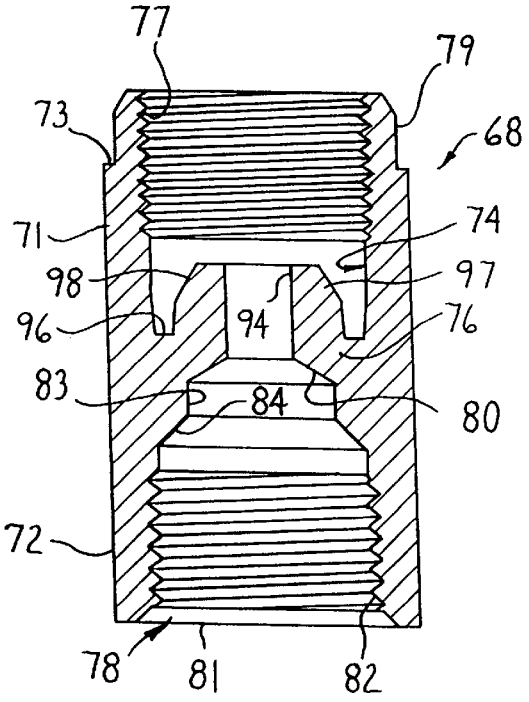
FIG. 3 is a cross sectional view of the lower housing member of the pilot of FIG. 2.
Figure 4:
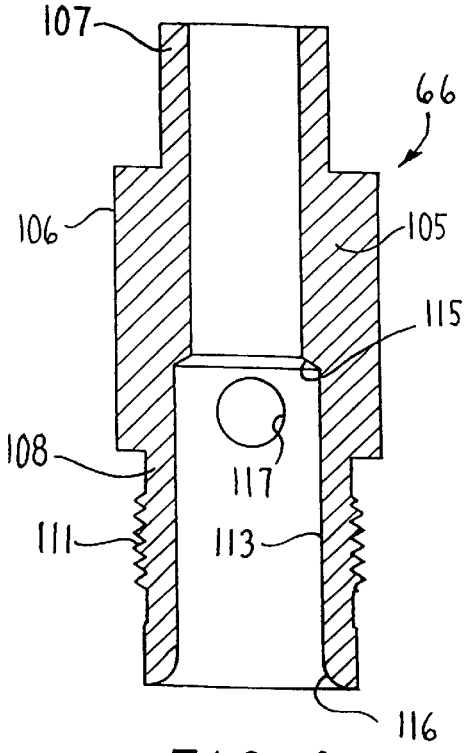
FIG. 4 is a cross sectional view of the upper housing member of the pilot of FIG. 2.

Certain terminology will be used in the following description for convenience in reference only and will not be limiting unless explicitly recited in the claims. The words "up", "down", "top", "bottom" will designate directions in the drawings to which reference is made. Such terminology will include derivatives and words of similar meaning.

DETAILED DESCRIPTION

FIGS. 1–4 disclose a pilot assembly 49 embodying the present invention. While the present invention may be embodied in other structures, for convenience in present disclosure the pilot assembly 49 of FIGS. 1–4 is described below as an improvement on, and hence modification of, the prior art pilot assembly 15 above discussed as to FIGS. 7–10. Thus, for convenient reference, parts of the inventive pilot assembly 49 (FIGS. 1–4) substantially corresponding to parts of the prior art pilot assembly 15 will be referred to by the same reference numerals, with the suffix "A" added. Thus, the FIGS. 1–4 pilot assembly may be similar to that shown in FIGS. 7–10 except as follows.

The inventive pilot assembly 49 (FIG. 1) includes an improved pilot 50. The pilot 50 (FIG. 2) includes a two-part housing 64 comprising a substantially tubular upper housing member 66 and a substantially tubular lower housing member 68.

The lower housing member 68 (FIGS. 2 and 3) comprises an elongate, generally cylindrical peripheral wall 71 whose exterior surface 72 is radially inwardly stepped at 73 to narrow the upper end portion 79. The step 73 seats against the bottom of the mounting bracket 17A. The lower housing member upper end portion 79 is fixed to the mounting bracket 17A by any conventional means, for example staking, welding, etc. The major length of the lower housing member 68 depends downwardly from the mounting bracket 17A and ends at 81. A diametral, preferably integral wall 76 divides the lower housing passage 74 into upper and lower internally threaded, recesses 77, 78. The diametral wall 76 includes a coaxial boss 97 protruding upwardly into the upper recess 77. An annular gap 96 radially spaces the boss 97 from the interior surface of the peripheral wall 71. The boss 97 has an upwardly inwardly tapered peripheral wall 98. The diametral wall 76 is axially perforated by a reduced diameter gas flow hole 94 coaxially connecting the greater diameter upper and lower recesses 77, 78.

The lower recess 78 (FIG. 3) is stepped radially outward and downward. Starting downward from the diametral wall 76, the lower recess 78 includes an inner, downward flared, tapered step 80; an increased diameter, cylindrical wall 83; an outer tapered step 84; and an internally threaded, substantially cylindrical mouth 82.

The ferrule 37A (FIG. 2), gas supply tube 28A and fitting 41A are all received in the mouth 82 of lower recess 78. Tightly threading the fitting 41A into the threaded mouth 82 gas sealingly seats the ferrule upper tapered surface 51A against the tapered step 84.

The upper housing member 66 (FIGS. 2 and 4) comprises an elongate, hollow, generally tubular wall 105 having upper and lower end portions 107 and 108, axially flanking a midportion 106. The midportion 106 has a wrench engageable (e.g. hexagonal) outer surface. The lower end portion 108 is externally threaded at 111. The upper and lower end portions 107, 108 are stepped radially inward from the periphery of the midportion 106. The upper housing member 66 includes a coaxially extending through passageway 113 having a downward facing, tapered annular midstep 115 and a convexly radiused bottom step 116. An air supply aperture 117 opens radially through the peripheral portion of the upper housing member 66 just below the midstep 115 and above the lower end portion 108.

The pilot 50 (FIG. 2) is assembled as follows. The lower housing member 68 is inserted upwardly snugly into a hole 124 in bracket 17A until the stop 73 abuts the underside of the bracket. The member 68 is fixed pendently to the bracket 17A by any convenient means (e.g. peening, welding, etc.).

The gas supply tube 28A, ferrule 37A and fitting 41A are then upwardly inserted in the lower recess 78. Threadedly tightening the fitting 41A in the threaded mount 82 sealingly wedges the tapered upper end 51A of the ferrule 37A against the tapered step 84 of the lower housing member 68.

Then, the orifice member 33A is centered in the upper recess 77 of the lower housing member 68 with its flared lip 101 coaxially fitted on the tapered peripheral wall 98 of the boss 97.

Then, the upper housing member 66 is sleeved over the orifice member 33A and threaded into the upper recess 77 of the lower housing member 68 until the lip 101 is tightly and sealingly sandwiched between the tapered wall 98 of the lower housing member 68 and the tapered bottom step 116 of the upper housing member 66. The tapers of the wall 98, step 116 and lip 101 are substantially equal to provide a circumferentially complete axially extended gas seal therebetween.

To convert the pilot 50 to a different fuel gas, the upper housing member 66 and orifice member 33A are upwardly removed from the lower housing member 68, a new orifice member 33A of different, suitable orifice 34A diameter is inserted and the upper housing member 66 is replaced on the lower housing member 68. Advantageously, this can be done from entirely above the bracket 17A and there is no need of access below the bracket 17A or removal of the gas supply tube 28A (or electrical members 24, 25 or 26) or dismantling of bracket 17A or adjacent user structure (e.g. FIG. 7 fireplace structure).

MODIFICATION

Figure 5:
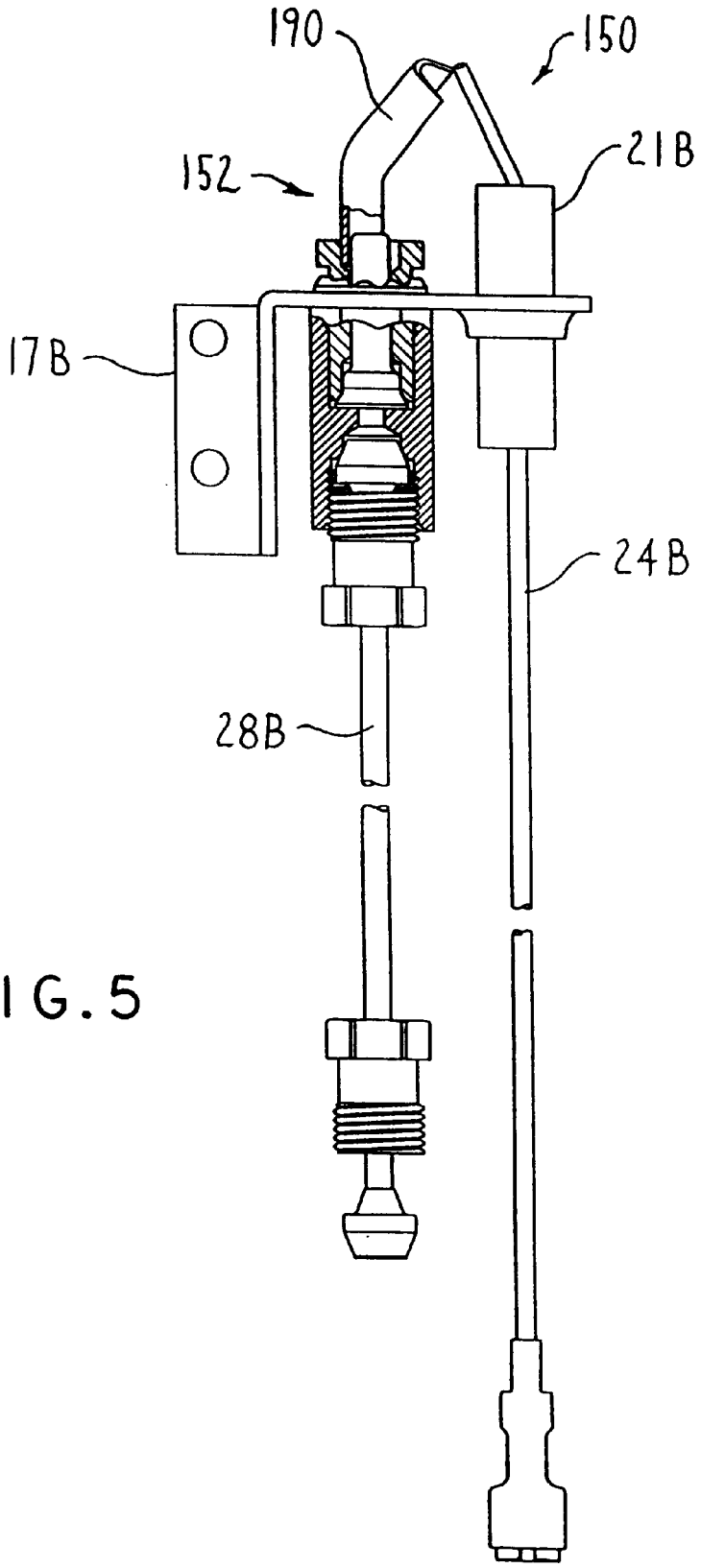
FIG. 5 is an elevational view of a modified pilot assembly embodying the invention.
Figure 6:
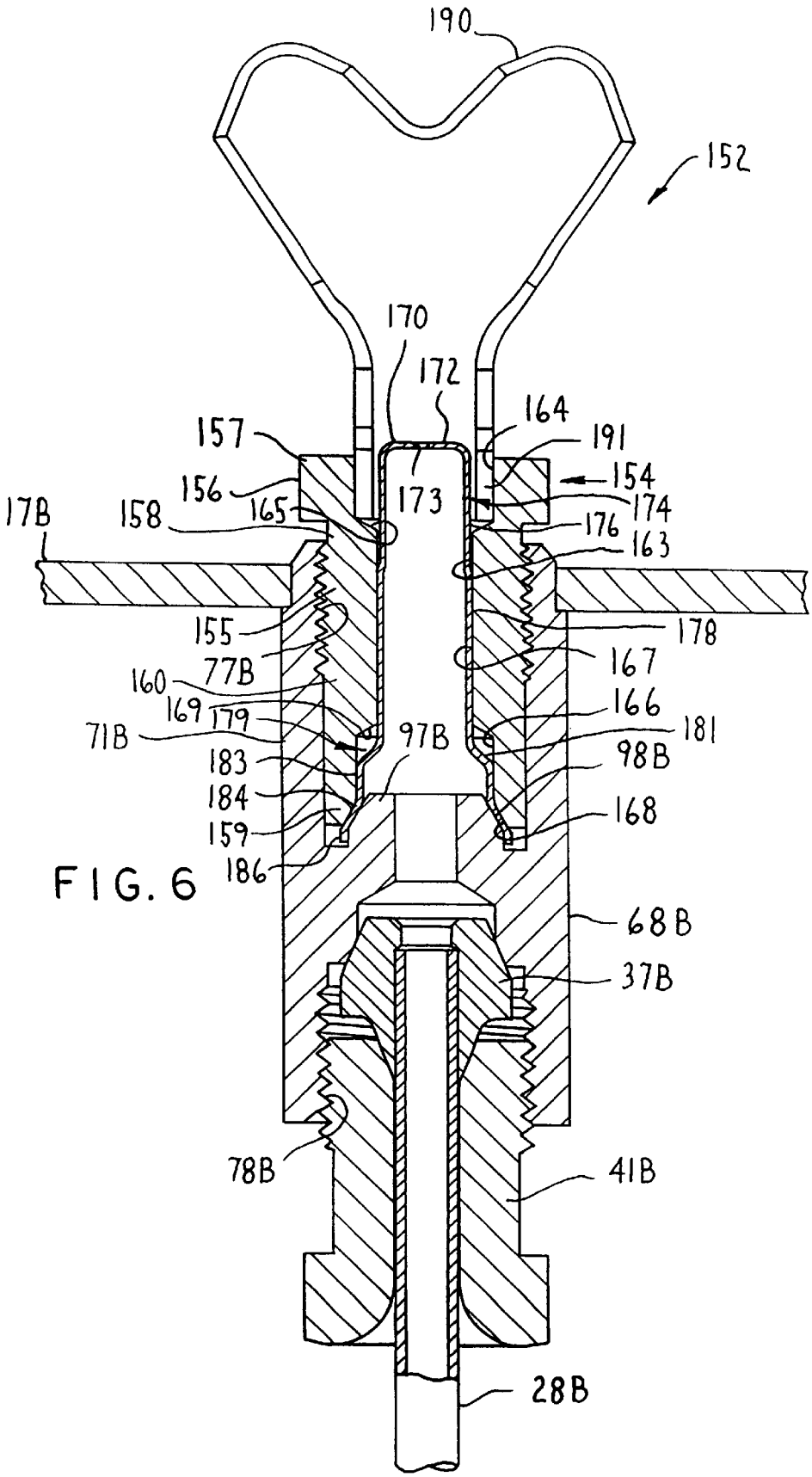
FIG. 6 is a cross sectional view of the pilot of FIG. 5.
Figure 7:
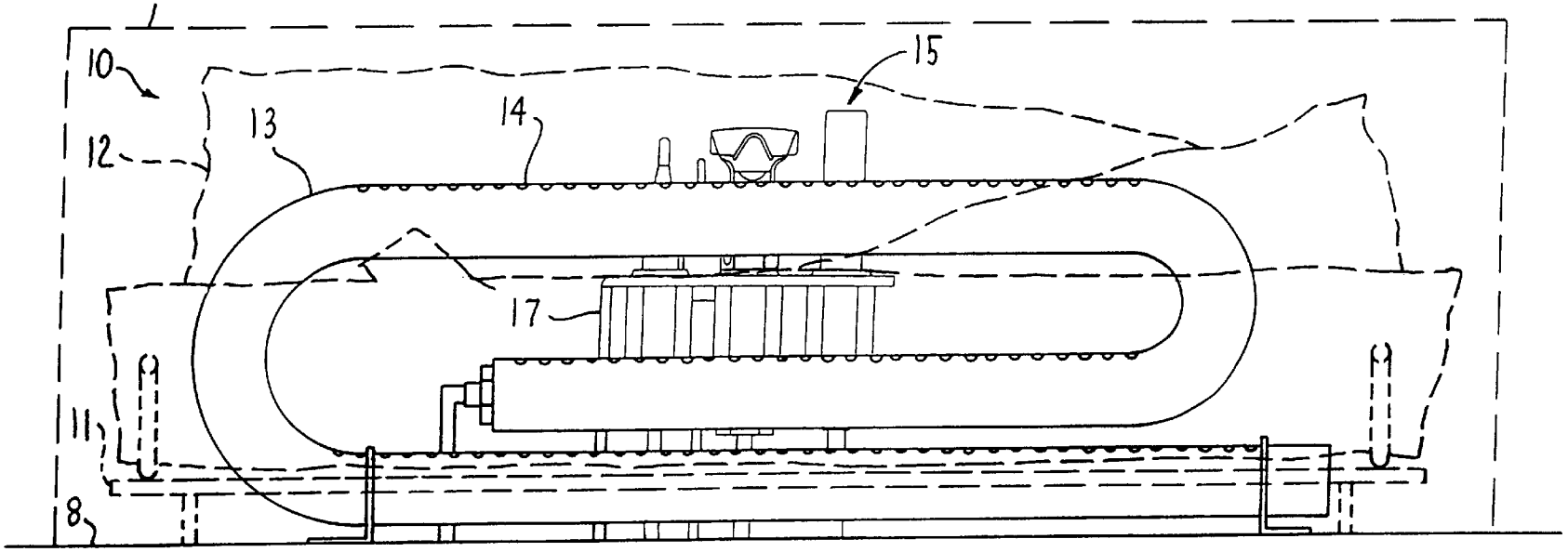
FIG. 7 PRIOR ART
FIG. 7 is a front view of a typical conventional fireplace, equipped with a prior art pilot assembly, and with the fireplace box, grate, and nonflammable logs shown in broken line.
Figure 8:
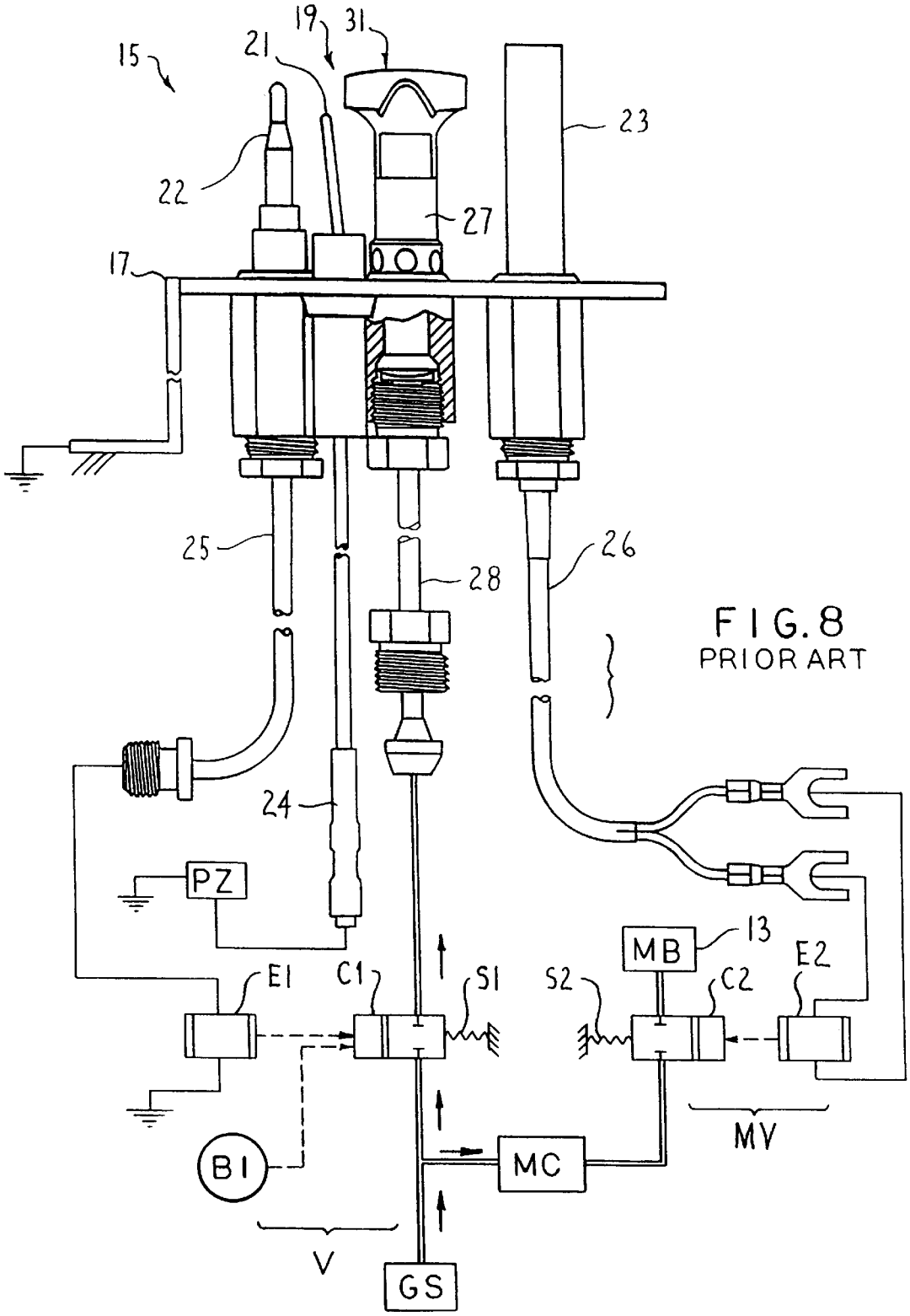
FIG. 8 PRIOR ART
FIG. 8 is a front view of the prior art pilot assembly of FIG. 7.
Figure 9:
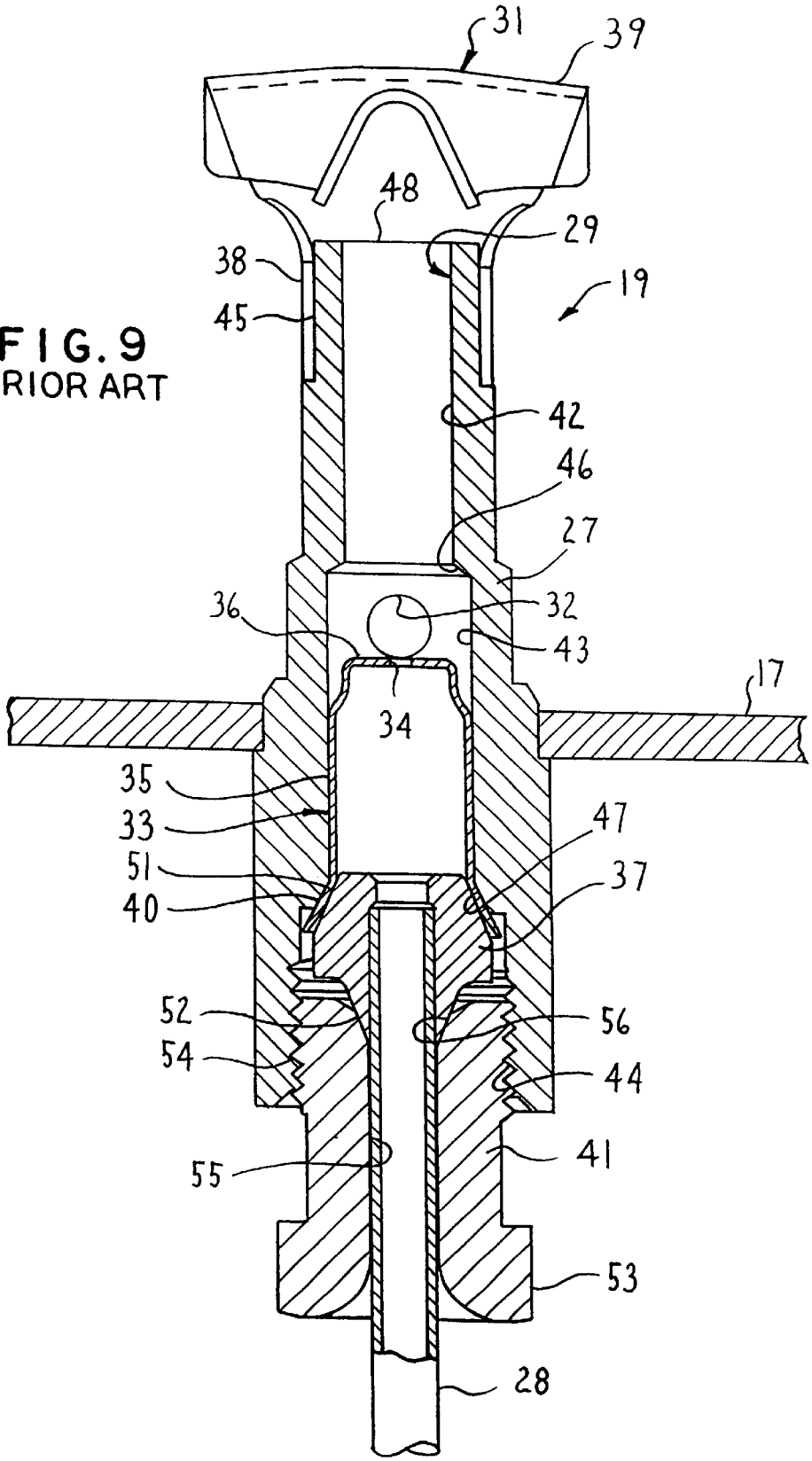
FIG. 9 PRIOR ART
FIG. 9 is a cross sectional view of the prior art pilot of FIG. 8.
Figure 10:
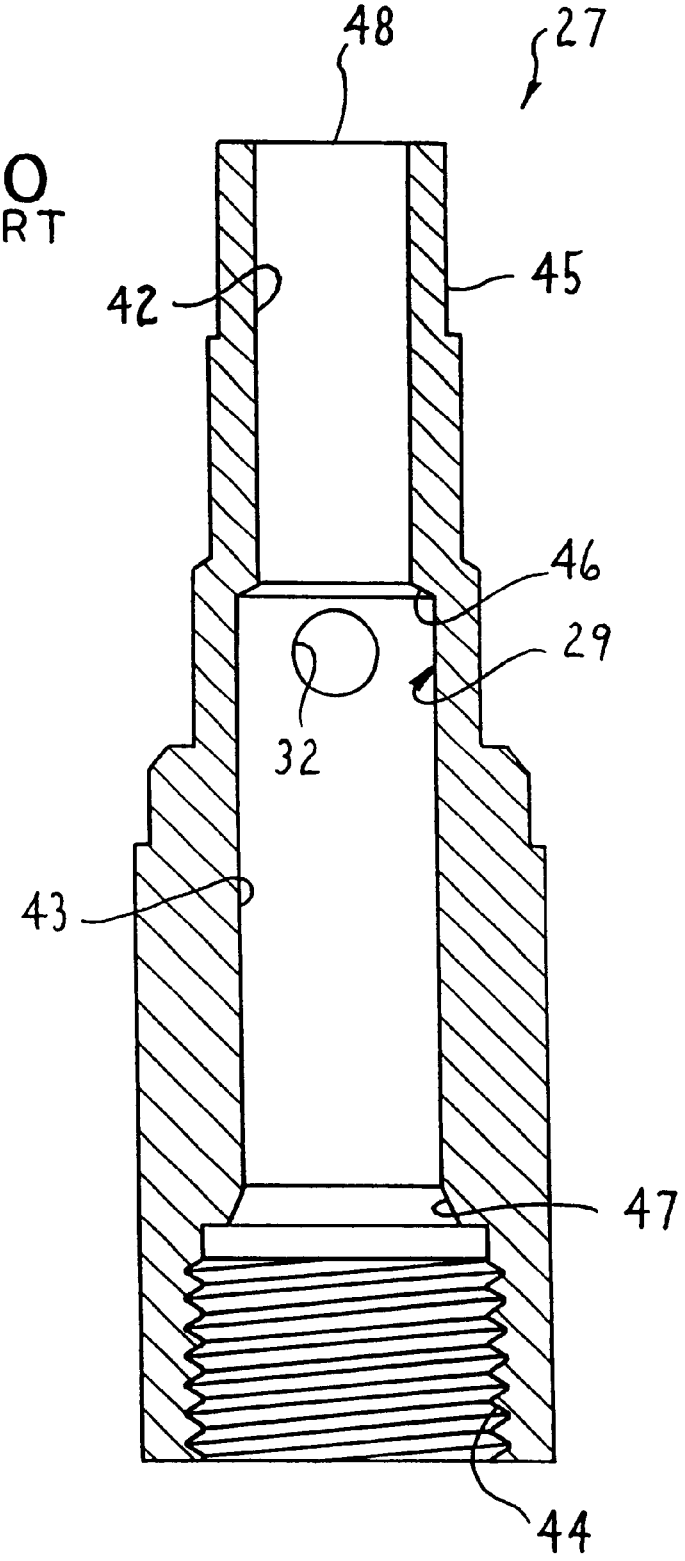
FIG. 10 PRIOR ART
FIG. 10 is a cross sectional view of the housing of the FIG. 9 pilot.

A typical modified inventive pilot assembly 150 (FIGS. 5 and 6) may be used in water heaters. For convenient reference parts of the pilot assembly 150 substantially corresponding to parts of the pilot assembly 49 of FIG. 1 will be referred to by the same reference numerals with the suffix "B" added. The FIGS. 5 and 6 pilot assembly is preferably similar to that of FIGS. 1–4 except as follows.

The modified pilot assembly 150 (FIGS. 5 and 6) includes a bracket 17B, which fixedly mounts an ignitor 21B and a pilot 152.

The pilot 152 has a lower housing member 68B (FIG. 6) fixed to and depending from the bracket 17B. The lower body member 68B differs from the member 68 (FIG. 3) primarily in that its peripheral wall 71B is longer, axially between the threads 77B and the boss 97B, than the peripheral wall 71.

The pilot 152 includes an upper housing member 154.

The upper housing member 154 (FIG. 6) has an elongate, generally tubular peripheral wall 155 having upper and lower end portions 157 and 159 flanking a midportion 160. The upper end portion 157 has a wrench engageable (e.g. hexagonal) outer surface portion 156. The midportion 160 has a threaded outer surface 158. The member 154 has a coaxial through passage 163. The passage 163 is generally of hour glass shape and includes an upper, enlarged diameter, target receiving recess 164, a lower, enlarged diameter recess 166, and a reduced diameter intermediate portion 167 connected by tapered steps 165 and 169 to the upper and lower recesses 164 and 166. The lower recess 166 has a downward facing, tapered step 168 at its lower end.

An inverted, cup shaped orifice member 170 includes a top end wall 172, a stepped peripheral wall 174 depending from end wall 172, and a stepped flared skirt 179 depending from the peripheral wall 174. The top end wall includes a central orifice 173. The peripheral wall 174 includes an upper wall portion 176, which has a diameter less than the intermediate passage portion 167 and extends downwardly partly into the intermediate passage portion 167, and a lower wall portion 178 of diameter slightly greater than the upper wall portion 176. The skirt 179, in descending order, includes an upper, downward facing, frustoconical step 181, an upper cylindrical part 183, a lower, downward facing frustoconical step 184, and a lower cylindrical part 186.

A bidirectional target 190 (FIG. 6) includes a semicylindrical mounting base 191. The base 191 is fixed in the target receiving recess 164 by any conventional means, for example by welding.

The pilot 152 is preferably assembled as follows. First, the gas supply tube 28B, ferrule 37B, lower housing member 68B and bracket 17B may be assembled together in the manner shown in FIG. 6 and generally as discussed above with respect to corresponding elements 28A, 37A, 68 and 17A of FIGS. 1 through 4.

Then, the orifice member 170 (FIG. 6) is centered in the upper recess 77B of the lower housing member 68B with its tapered stop 168 coaxially fitted on the tapered peripheral wall 98B of the boss 97B.

Then, the upper housing member 154 is sleeved over the orifice member 170 and threaded into the upper recess 77B of the lower housing member 68B until it stops. As a result, the upper housing member snugly radially backs the orifice member lower peripheral wall portion 178. Also, the boss tapered peripheral wall 98B and opposed upper housing member tapered step 168 tightly and sealingly sandwich the orifice member lower frustoconical part 184 (such elements 98B, 168 and 184 having substantially identical tapers to facilitate sealing). Further, the orifice member upper peripheral wall portion 176 extends loosely up into the target mounting base 191, ending just above the top of the upper housing member 154.

Thus, gas exits the orifice 173 directly into the target 190 (not into the housing as in the FIG. 1–4 embodiment), whereat the gas ignites into the pilot flame.

Advantageously, the pilot assembly 50, 150 allows removal and replacement of the orifice member 33A, 170 from above the mounting bracket 17A, 17B by providing a two part pilot, in which the upper housing member 66, 154 can be respectively removed from above the mounting bracket 17A, 17B to allow replacement of the orifice member 33A, 170 from above.

Although particular preferred embodiments of the invention have been disclosed in detail for illustrative purposes, it will be understood that variations and modifications of the disclosed apparatus, including the rearrangement of parts, lie within the scope of the present invention.

What is claimed is:

1. A pilot assembly for providing a pilot flame to ignite gas in a gas burning device, comprising:

a monolithic, generally tubular first element formed of a single piece of material and having:

(1) opposite first and second ends, (2) first and second end recesses axially opening through said first and second ends, respectively, of said first element, (3) an integral, radially inward extending, diametral wall axially spaced intermediate said first and second ends, said integral diametral wall axially separating said first and second end recesses, said integral diametral wall having a gas connector ferrule engaging and sealing surface adjacent the inner end of said first recess and facing into said first recess, (4) an opening axially through said integral diametral wall and axially communicating said first recess with said second recess, said opening being of diameter less than that of said recesses;

a mounting bracket, said first element opening through and being fixed adjacent its second end to said mounting bracket, said first element extending away from a first side of said mounting bracket;

a generally tubular second element having a first end removably fixed with respect to said first element, said second element extending away from a second side of said mounting bracket and said first element;

a generally tubular member fixedly removably received in said second recess of said first element, said integral diametral wall of said first element axially backing said generally tubular member, said generally tubular member comprising a gas passage axially therethrough and a radial wall across said gas passage, said radial wall having a gas metering orifice axially therethrough and of diameter less than said gas passage.

2. The apparatus of claim 1 including a gas supply connector unit removably disposed in said first recess and comprising:

(1) a tubular fitting removably threaded into said first recess of said first element and having an interior end, (2) a gas supply conduit extending snugly and axially through said tubular fitting and having an outlet end in gas supplying communication with a first end of said axial through opening in said integral diametral wall of said first element, (3) an annular ferrule fixed on and extending radially outward from said gas supply conduit adjacent said outlet end of said conduit, said ferrule being removably fixed in axially clamped, gas sealing relation between the interior end of said fitting and said integral diametral wall of said first element.

3. The apparatus of claim 1 in which said generally tubular member is a gas metering element formed in one piece, said radial wall being integral with said gas metering element and defining an end thereof.

4. The apparatus of claim 1 in which said second recess of said first element is internally threaded.

5. The apparatus of claim 4 in which said second element is removably threaded into said second recess of said first element.

6. The apparatus of claim 1 in which said generally tubular member has a first end abutting said integral diametral wall of said first element.

7. The apparatus of claim 6 in which said first end of said generally tubular member has a radially outward extending flange removably axially clamped by said integral diametral wall of said first element and said first end of said second element.

8. The apparatus of claim 1 including a gas supply tube tipped by a ferrule, said ferrule being removably fixed in said first recess of said first element, said integral diametral wall spacing said generally tubular member from said gas supply tube and ferrule, such that removal of said tube and ferrule from said first element has no effect on positioning of said generally tubular member in said first element.

9. The apparatus of claim 1 in which said generally tubular member has a tapered portion engaging said integral diametral wall adjacent said opening through said integral diametral wall, said generally tubular member carrying a gas metering orifice.

10. The apparatus of claim 1 in which said generally tubular member has a second end portion adjacent said second end of said first element and extending into said first end of said second element.

11. A pilot assembly for providing a pilot flame to ignite gas in a gas burning device, comprising:

a generally tubular first element having:

(1) opposite first and second ends, (2) first and second recesses axially opening through said first and second ends respectively of said first element, a mounting bracket, said first element opening through and being fixed adjacent its second end to said mounting bracket, said first element extending away from a first side of said mounting bracket;

a generally tubular second element having a first end removably fixed with respect to and telescoped in said second recess of said first element, said second element extending away from a second side of said mounting bracket and from said first element;

a generally tubular member having a first end portion fixedly removably received in said second recess of said first element, said generally tubular member having a gas passage axially therethrough.

12. The apparatus of claim 11 in which said second element has its first end telescoped in said second recess of said first element.

13. The apparatus of claim 12 in which telescoped portions of said first and second elements have interengaging structure which releasably axially fixes said second element to said first element.

14. The apparatus of claim 13 in which said interengaging structure comprises a generally circumferentially extending groove in the outer peripheral wall of said second element and structure extending radially inward of said first element and received in said generally circumferentially extending groove in relative axial motion blocking relation and therewith releasably fixing said second element on said first element.

15. The apparatus of claim 13 in which said interengaging structure comprises interengaging threads on said first and second generally tubular elements, said groove comprising a segment of a spiral thread axially between spiral thread ridges, said structure received in said groove comprising a segment of a further thread ridge extending integrally and spirally on inner peripheral wall of said second element.

16. The apparatus of claim 13 in which said second member is fixed to said first member independent of said mount.

17. A pilot assembly for producing a pilot flame to ignite gas in a gas burning device, comprising:

a generally tubular first element and a gas passage extending axially through said first element;

a mounting bracket, said first element opening through and being fixed adjacent its second end on said mounting bracket, said first element extending away from a first side of said mounting bracket;

a substantially tubular second element having a first end adjacent and removably fixed with respect to said first element, said second element extending away from a second side of said mounting bracket and from said first element;

a generally tubular member having a first end portion fixedly removably received in said first element, said generally tubular member having a gas passage axially therethrough, said generally tubular member being at least partially received in said first end of said generally tubular second element.

18. The apparatus of claim 17 in which said generally tubular member is a gas metering element formed in one piece, said gas metering element having an integral end wall across the gas passage, said integral end wall having a gas metering orifice axially therethrough.

19. The apparatus of claim 17 in which said first element has first and second end opening recesses separated by an integral, radially inward extending, diametral wall axially spaced intermediate the ends of said first element, said integral diametral wall including an axial through opening communicating said first recess with said second recess, said generally tubular member having an inboard end engaging and backed by said diametral wall to accurately locate the inboard operating position of said generally tubular member in said first element.

20. The apparatus of claim 19 in which said mounting bracket extends substantially horizontally, said first element depending from said mounting bracket, said second element extending above said mounting bracket, said second element having a bottom portion telescoped within a top portion of said first element, the telescoped portions of said first and second elements having interengagable threads having:

(1) a tightened position wherein said second member downwardly clamps said generally tubular member against said integral diametral wall of said first element, and (2) an unthreaded position with said second element lifted from the top of said first element and said generally tubular member having a generally cylindrical top portion conveniently protruding upward beyond said first element and engageable between a user's finger and thumb to lift said generally tubular member from the top of said first element.

21. A method of adapting a gas pilot to different gas types, comprising the steps of:

providing a generally tubular first member having (1) a gas flow passage therethrough, (2) a transverse annular wall partly blocking said passage and separating elongate upper and lower portions of said passage, (3) interior first threads within said passage upper portion, and (4) gas supply connection structure on its lower portion and including second threads;

providing a mount;

providing a generally tubular second member having a gas flow passage therethrough and third threads on its lower portion;

providing plural generally tubular third members respectively carrying differing size orifices suitable for metering different conductive gases;

fixedly depending said first member from said mount;

inserting one said generally tubular third member in said upper passage portion of said first member from above said mount and seating same on said transverse annular wall of said first member;

interengaging said first and third threads and threadedly rotating said second member into the upper passage portion of said first member until a portion of said second member urges said one third member against said first member transverse wall in sealed engagement therewith.

22. The method of claim 21 including reversely rotating said second member with respect to said first member and therewith unthreading said second member off from said first member, removing said one third member from the top of said first member, inserting a different said third member in the top of said first member, and again rotating second member with respect to said first member until the portion of said second member urges said different third member against said first member transverse wall in sealed engagement therewith.

23. The method of claim 21 including providing a gas supply connector having fourth threads, interengaging said second and fourth threads, rotating said gas supply connector with respect to said first member to thread said gas supply connector on said first member without disturbing the location of the third member seated on said transverse wall, reversely rotating said gas supply connector with respect to said first member to remove said gas supply connector from said first member without disturbing the location of said third member seated on said transverse wall.

24. The apparatus of claim 11 in which said generally tubular member is a gas metering element formed in one piece, said gas metering element having an integral end wall across the gas passage, said integral end wall having a gas metering orifice axially therethrough.

25. A pilot assembly for providing a pilot flame to ignite gas in a gas burning device, comprising:

a mounting bracket;

a generally tubular first member fixedly depending from said mounting bracket, said first member having a gas receiving portion to one side of said mounting bracket;

a generally tubular second member extending from the other side of said mounting bracket, having a pilot flame emitting portion remote from said mounting bracket, and being removably fixed with respect to said first member;

a third member disposed in a gas passage extending through said generally tubular first and second members, said third member having a gas flow regulating orifice disposed in said gas flow passage and being accessible for replacement with said second member removed from said first member, in which said second member is directly removably fixed to said first member by cooperating threads on said first and second members.

26. The apparatus of claim 25 in which said third member includes an integral transverse wall pierced by said orifice.

* * * * *